US005884126A

United States Patent [19]

Schoch et al.

[11] Patent Number: 5,884,126

[45] Date of Patent: Mar. 16, 1999

[54] APPARATUS AND METHOD FOR TRANSPORTING FINELY POWDERED TONER MATERIAL

[75] Inventors: Bernd Schoch, Markt Schwaben; Walter Kopp, Taufkirchen, both of Germany

[73] Assignee: Oce Printing Systems GmbH, Poing, Germany

[21] Appl. No.: 993,585

[22] Filed: Dec. 18, 1997

[30] Foreign Application Priority Data

Dec. 18, 1996 [DE] Germany ..... 196 52 865.8

[51] Int. Cl.[6] ..... G03G 15/08

[52] U.S. Cl. ..... 399/258; 399/254; 406/89

[58] Field of Search ..... 399/254, 258, 399/260, 292; 406/89, 90; 222/195

[56] References Cited

U.S. PATENT DOCUMENTS

| | | | |
|---|---|---|---|
| 2,527,455 | 10/1950 | Schemm | 406/89 |
| 3,024,071 | 3/1962 | Morrow | 406/89 |
| 4,027,607 | 6/1977 | Pan et al. | 118/678 |
| 4,926,217 | 5/1990 | Bares | 399/254 |

FOREIGN PATENT DOCUMENTS

| | | |
|---|---|---|
| 1 522 656 | 10/1969 | Germany . |
| 25 09 831 | 9/1975 | Germany . |
| 33 44 436 | 6/1985 | Germany . |

OTHER PUBLICATIONS

Japanese patent abstract, 08198202, Aug. 6, 1996.

*Primary Examiner*—Joan Pendergrass
*Attorney, Agent, or Firm*—Hill & Simpson

[57] ABSTRACT

For transporting finely powdered toner material from a reservoir to a delivery opening, a porous bed that forms a down grade is charged with compressed air proceeding from below, whereby the toner material mixes with air to form a liquid-like mixture. This mixture flows along the down grade from the reservoir to the delivery opening.

15 Claims, 5 Drawing Sheets

APPARATUS AND METHOD FOR TRANSPORTING FINELY POWDERED TONER MATERIAL

BACKGROUND OF THE INVENTION

1. Field of the Invention

The present invention is directed generally to an apparatus and to a method for transporting finely powdered toner, particularly toner of a printer or copier, from a reservoir with toner to a delivery opening at a destination location for the toner, and in particular for the transport of the toner to a developer station of a printer or copier.

2. Description of the Related Art

In electrophotographically working printers or copiers, toner is transported from a reservoir to a toner employment location such as, for example, to a developer station. In the known apparatus, this occurs by toner being conveyed with an under-pressure system through channels, pipes and hoses. Transport speeds of about 10 m/s which occur in such a system lead to toner contact with the walls of the channels, pipes and hoses at a high mechanical energy. The mechanical and electrostatic properties of the toner change due to this contact, which leads to a deterioration of the printing quality.

In the known printers, the tone-carrying channels, pipes and hoses are therefore arranged such that no deflection of the toner stream ensues insofar as possible because the highest mechanical stressing of the toner ensues at deflections. Since it cannot be avoided, the mechanical stressing of the toner when contacting channels, pipes and hoses proceeding on a straight line must be accepted.

In electrophotographic high-performance printers that print without interruption when changing the toner container, a buffering of the toner is required in order to offer toner during the time for a container replacement. The toner buffer required for the buffering of the toner also requires additional space in addition to the toner-carrying channels, pipes and hoses, which results in a space problem arising in the printer housing.

SUMMARY OF THE INVENTION

The invention is based on an object of providing an apparatus for transporting toner from a reservoir to a developer station of a printer or copier, whereby the toner is subjected to a minimal mechanical and electrostatic influence, or stress, and that simultaneously enables a buffering of the toner.

This and other objects and advantages are achieved by an apparatus for transporting finely powdered toner material, particularly toner for a printer or copier, from a reservoir for the finely powdered material to a delivery opening, the apparatus including a bed extending from the toner reservoir to the delivery opening, the bed having an upper end located at the reservoir which is loaded with finely powdered toner material from the reservoir on its upper side and having a lower end located at the delivery opening at which the finely powdered toner material is delivered from the bed, the bed is porous at least in some sections, the bed forms a down grade, or downward pitch, between the reservoir and the delivery opening whose maximum slant is less than the angle of repose of the finely powdered material, and the bed is charged with compressed air proceeding from its underside.

Compressed air emerges through the pores of the bed to the upper side of the bed, as a result the finely powdered material on the upper side of the bed is mixed with compressed air and is brought into a fluid-like or liquid-like state. The finely powdered toner material which is fluidized in this way can flow down along the downward slope of the bed and proceed to the delivery opening. The toner is thus transported by the force of gravity. Additionally, the finely powdered toner material that is distributed over the entire down grade represents a reserve that serves the purpose of buffering.

In an advantageous embodiment of the apparatus, the porous bed is a slanting planar member and forms a down grade with a constant slant, and the bed is preferably porous over its entire length. The toner can thus be fluidized in all regions of the bed, so that no back-up can occur on the down grade.

Expediently, the reservoir is located above the upper end of the porous bed and a destination location is located under the lower end of the porous bed. This enables the supply and delivery of the toner to and from the conveyor apparatus to take place under the force of gravity.

The diameter of the pores in the porous bed is preferably smaller than the diameter of the particles of the finely powdered material. Toner particles are thus prevented from falling through the porous bed and leading to a blockage, to toner loss and to contamination when, for example, the compressed air charge, or flow, is shut off.

For charging the porous bed with compressed air at the underside of the porous bed, a through chamber extending from the upper end of the bed to its lower end is connected to a compressed air source that is provided according to a specific embodiment of the invention. The through chamber enables a uniform delivery of compressed air to take place and, thus, a uniform fluidization and uniform transport of the toner occurs over the entire length of the bed of the conveyor means.

In another embodiment of the invention, the chamber at the underside of the porous bed is divided along the down grade into sub-chambers that are separated in an airtight manor from one another that can be separately charged with the compressed air, as a result whereof finely powdered toner material that is located on the upper side of the porous bed can be separately fluidized in corresponding sub-regions along the down grade. In particular, each sub-chamber is separately connected to a compressed air source for the separate charging with compressed air. As a result of this separate fluidization of the individual sub-regions, toner can be transported section-by-section on the bed and accumulated as needed.

In another embodiment, at least one essentially vertically residing barrier is provided at the upper side of the porous bed. This barrier enables fluidized toner to be piled up, as a result the buffer capacity of the conveyor apparatus is enhanced.

Expediently, the vertical barrier is located at the lower end of the porous bed. The maximum buffer volume can thus be achieved over the entire down grade of the conveyor apparatus.

A number of toner sub-buffers can be realized in series by attaching a plurality of successive barriers along the down grade. At least one of the barriers has an overflow at its upper edge. Fluidized toner from a full toner sub-buffer can flow off over this overflow.

In another exemplary embodiment, the vertical barrier has at least one opening at its lower edge in the region of the upper surface of the porous bed. Fluidized toner from a full toner sub-buffer can flow off in a siphon-like manor through this opening.

Advantageously, an essentially vertically residing barrier is provided in each of the plurality of sub-regions of the down grade, each barrier having at least one opening at its lower edge in the region of the upper surface of the porous beds. This enables a designational, siphon-like discharge and further-transport from one toner sub-buffer to the next by designational fluidization of the toner in the respective sub-region.

For conveying the finely powdered material with the present apparatus, the porous bed is loaded with finely powdered toner material from the reservoir in the region of its upper end, the porous bed is charged with compressed air proceeding from its underside, and as a result the finely powdered toner material deposited on the upper side of the porous bed is fluidized and, under the influence of gravity, begins to flow along the down grade from the upper end of the porous bed to the lower end of the porous bed. The fluidized, finely powdered toner material arriving at the lower end of the porous bed is delivered to a delivery opening at the destination location.

BRIEF DESCRIPTION OF THE DRAWINGS

Further advantages, features and possible applications of the invention derive from the following description of preferred exemplary embodiments with reference to the drawings.

DETAILED DESCRIPTION OF THE PREFERRED EMBODIMENTS

Figure 1:
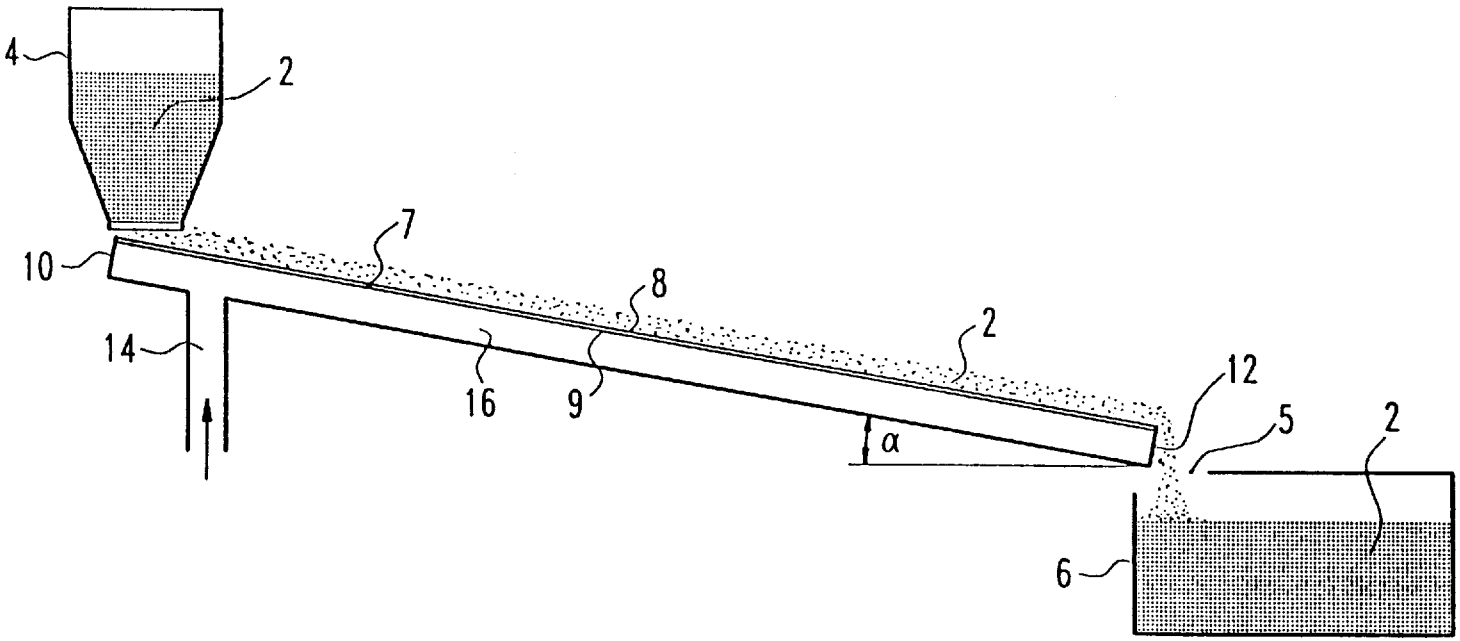
FIG. 1 shows a side cross sectional view of a first exemplary embodiment of the present invention with a porous toner transport bed.

FIG. 1 schematically shows a first exemplary embodiment of the inventive apparatus. A porous bed or plate 7 forms an oblique plane that is inclined at an angle $\alpha$ relative to horizontal. An upper end 10 of the bed 7 is located under a reservoir 4 for toner 2. A lower end 12 of the bed 7 is located above a developer station 6 to which the toner 2 is to be supplied via a delivery opening 5. A chamber 14 that can be charged with compressed air adjoins the underside 9 of the porous bed 7 along the entire length of the porous bed 7 from its upper end 10 to its lower end 12. A layer of toner particles 2 which have an essentially constant layer thickness is spread over the entire length of the porous bed on the upper surface 8 of the bed 7. To prevent toner particles 2 from unintentionally sliding along the down grade between the upper end 10 and the lower end 12, the angle $\alpha$ must be smaller than the angle of repose of the toner material 2. Further, the coefficient of static friction between the upper side 8 of the porous bed 7 and the toner material 2 in the powdered state must likewise be high enough to prevent the entire layer of toner material 2 from sliding down the down grade in a carpet-like mass and falling into the developer station 6.

When the chamber 16 is charged with compressed air 14, compressed air passes through the porous bed 7 from its underside 9 to its upper side 8 through the pores, as a result whereof a mixture of toner and compressed air, what is referred to as fluidized toner 2 (shown in the drawings as a dotted region), is formed on the porous bed 7. This mixture of toner and compressed air behaves like a liquid, and it begins to flow on the oblique plane from the upper end 10 to the lower end 12. This process is also referred to as fluidization. When toner is poured from the reservoir 4 onto the porous bed 7, the fluidization causes it to continuously be conveyed from the upper end 10 to the lower end 12 and delivered to the developer station 6. As soon as the charging of the chamber 16 with compressed are 14 is ended, the toner 2 on the porous bed 7 converts from its highly mobile, fluidized state to its less mobile powdered state. In other words, the toner 2 settles onto the bed 7. The transport of the toner over the down grade can be stopped suddenly in this way.

The toner transport via the inclined, porous bed 7 is gentle on the toner since the toner is not deflected during its transport and the toner particles-contact practically no wails of channels, pipes or hoses. Further, the toner material 2 which is distributed over the entire down grade forms a considerable buffer of toner material, so that the developer station 6 continues to be supplied with toner 2 via the delivery opening given a temporary ebbing of the toner replenishment from the reservoir 4. Over and above this, the degree of fluidization and, thus, the flow behavior of the fluidized toner 2 can be controlled by designationally modifying the pressure of the compressed air flowing into the chamber 16. In this way, the feed of the toner 2 to the developer station 6 can also be controlled via a dosing of the compressed air charging of the chamber 16 in addition to being controlled by dosed output from the reservoir 4.

The porous bed or plate 7 is, for example, of sintered metal, particularly sintered steel, of ceramic or of plastic, and the dimensions of the pores as well as the inclination angle $\alpha$ of the porous bed 7 are matched to the properties of the toner 2. The pore size lies at about 1 through 5 $\mu$m and is thus clearly smaller than the average diameter of the toner particles of about 10 $\mu$m which prevents toner particles from penetrating into the pores. The inclination angle a amounts to about 10° and is considerably smaller than the angle of repose of the toner 2 of about 70°. This and an adequately high coefficient of static friction between the toner 2 and the porous bed 7 assure that the toner 2 does not move along the down grade in its non-fluidized state.

Figure 2:
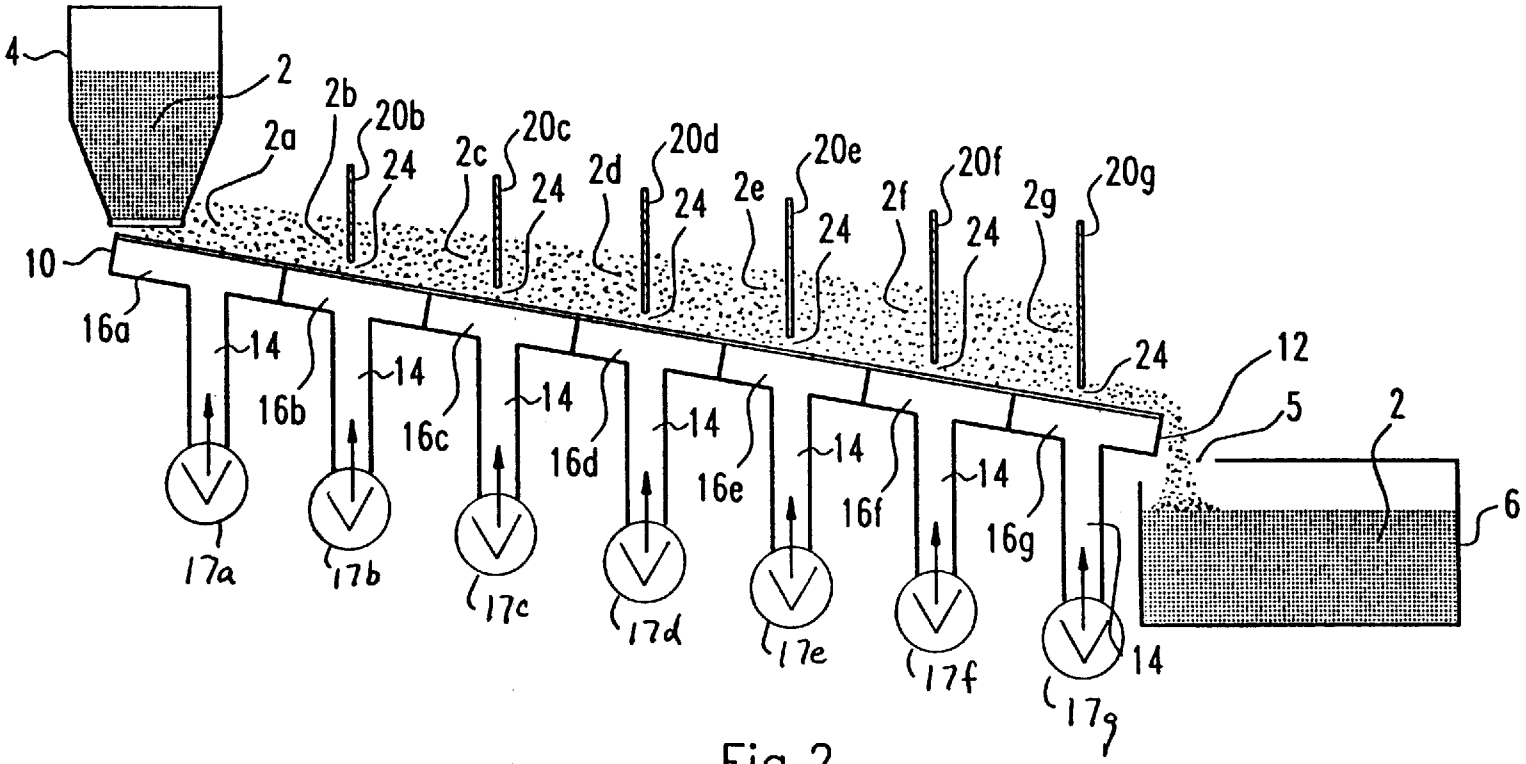
FIG. 2 shows a side cross sectional view of a second exemplary embodiment of the invention with separately drivable pressure chambers for the toner transport bed.

FIG. 2 shows a second exemplary embodiment of the inventive apparatus. As described in FIG. 1, the porous bed 7 here also extends from its upper end 10 under the reservoir 4 to its lower end 12 above the developer station 6. The chamber extending under the porous bed 7 is divided into a plurality of sub-chambers 16*a*–16*g*. Each of these sub-chambers can be separately charged with compressed air. This occurs by selection of the corresponding chamber with the assistance of compressed air valves 17*a*–17*g* for each sub-chamber 16*a*–16*g*. Essentially vertical barriers 20*b*–20*g* that form parting surfaces 8 extends from the central area relative to each of the sub-regions 2*b*–2*g* as determined by the sub-chambers 16*b*–16*g*. These successive barriers 20*b*–20*g* each have a opening 24 at the apex that is formed between the barrier 20*b*–20*g* and the porous bed 7. No toner transport occurs from the upper end 10 to the lower end 12 of the down grade in the quiescent condition, i.e. when powdered toner 2 is present in the sub-regions 2*b*–2*g*.

When, during operation of the apparatus, one of the sub-chambers 16*b*–16*g* is separately charged with compressed air 14, then a fluidization of the toner material 2 occurs in the corresponding sub-region 2*b*–2*g* lying above the sub-chamber. As a result thereof, fluidized toner material flows through the opening 24 from top to bottom under the influence of the force of gravity. In this way, one obtains a type of siphon effect at the opening 24 of the fluidized sub-region, as a result thereof toner material 2 in the fluidized state is transferred from a sub-region that is located higher to a neighboring sub-region that is lower. By activating and deactivating the compressed air charging of the respective sub-region, the openings 24 can thus be made transmissive for the toner material 2 (by generating fluidized toner) or, respectively, non-transmissive for the toner (when it is in the powdered state). By designational compressed air charging of the various sub-chambers 16*b*–16*g*, thus, the toner 2 distributed over the entire down grade can be designationally sluiced from sub-region to sub-region and, ultimately, to the developer station 6. The down grade that has been provided with barriers 20*b*–20*g* between the upper end 10 and the lower end can thus be employed as a conveying path and—at the same time—as a toner buffer with a variable capacity. The height of the barriers 20*b*–20*g*—which are increasing from top to bottom of the downwardly sloping bed 7—assures a storage capacity for the toner that is greater by a multiple than in the embodiment of FIG. 1.

Figure 3:
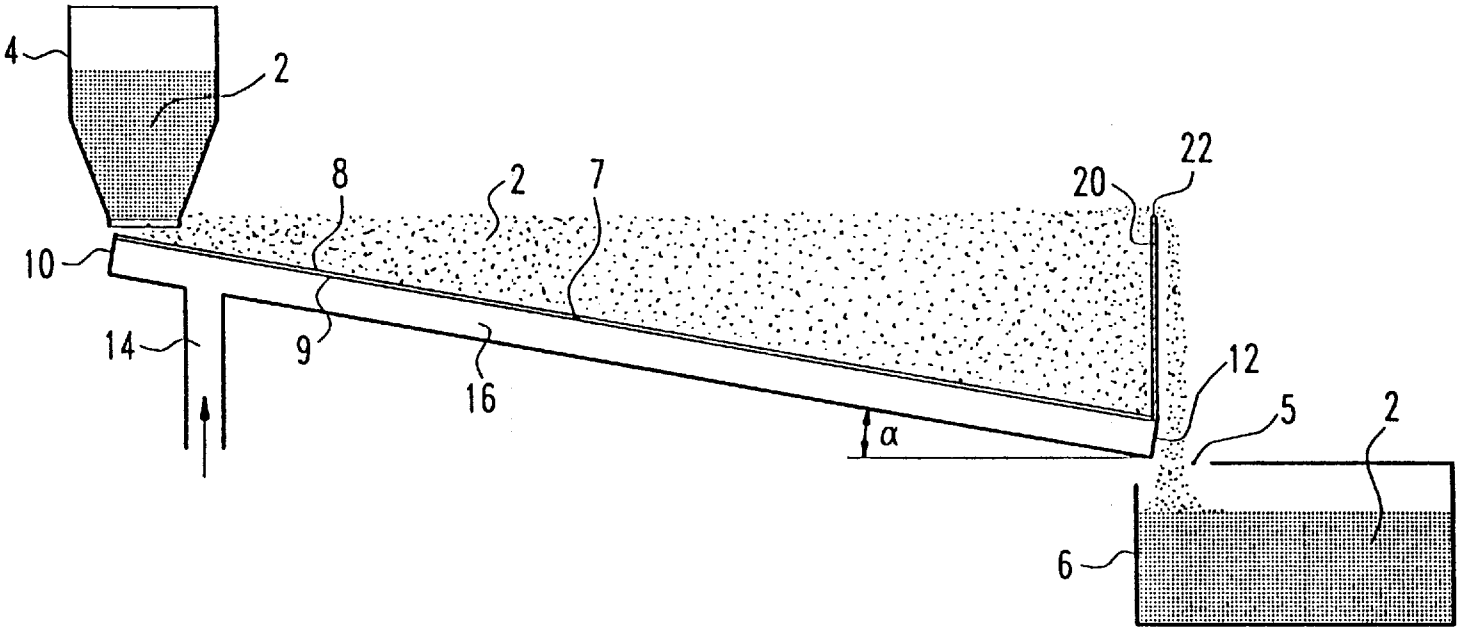
FIG. 3 shows a side cross sectional view of a third exemplary embodiment of the invention with a vertically residing barrier.

FIG. 3 shows a third exemplary embodiment of the inventive apparatus. This exemplary embodiment differs in structure from the embodiment of FIG. 1 on the basis of an essentially vertical barrier 20 provided at the lower end 12 of the porous bed 7. When the chamber 16 is charged with compressed air 14, the toner is fluidized over the entire down grade between the upper and 10 and the lower end 12 of the porous bed 7 and can thus flow from the reservoir 4 to the barrier 20. The fluidized toner material 2 can back up above the barrier 20 until it can pass the barrier at an overflow provided at the upper end of the barrier, whereupon the toner drops into the developer station 6. When the toner storage formed by the barrier 20 and the porous bed 7 is full with fluidized toner 2, an addition of toner 2 from the reservoir 4 effects an immediate rise of the upper toner level and a flow-off over the overflow 22. This has the advantage that the developer station 6 can be supplied with toner nearly without delay when a corresponding amount of toner is output from the reservoir 4. Since the ratio of toner volume to compressed air volume in the fluidized state amounts to about 1:10, a toner storage that is full of fluidized toner 2 is filled only slightly with powdered toner after cessation of the compressed air flow. In this exemplary embodiment, the amount of toner supplied to the developer station 6 per time unit can also be controlled, on the one hand, by the amount of toner output from the reservoir 4 per time unit and, on the other hand, by the pressure of the compressed air serving for charging the chamber 16.

For example, the toner storage can be caused to overflow by adding an adequate quantity of toner material from the reservoir 4 and/or be increasing the pressure of the compressed air 14.

Figure 4:
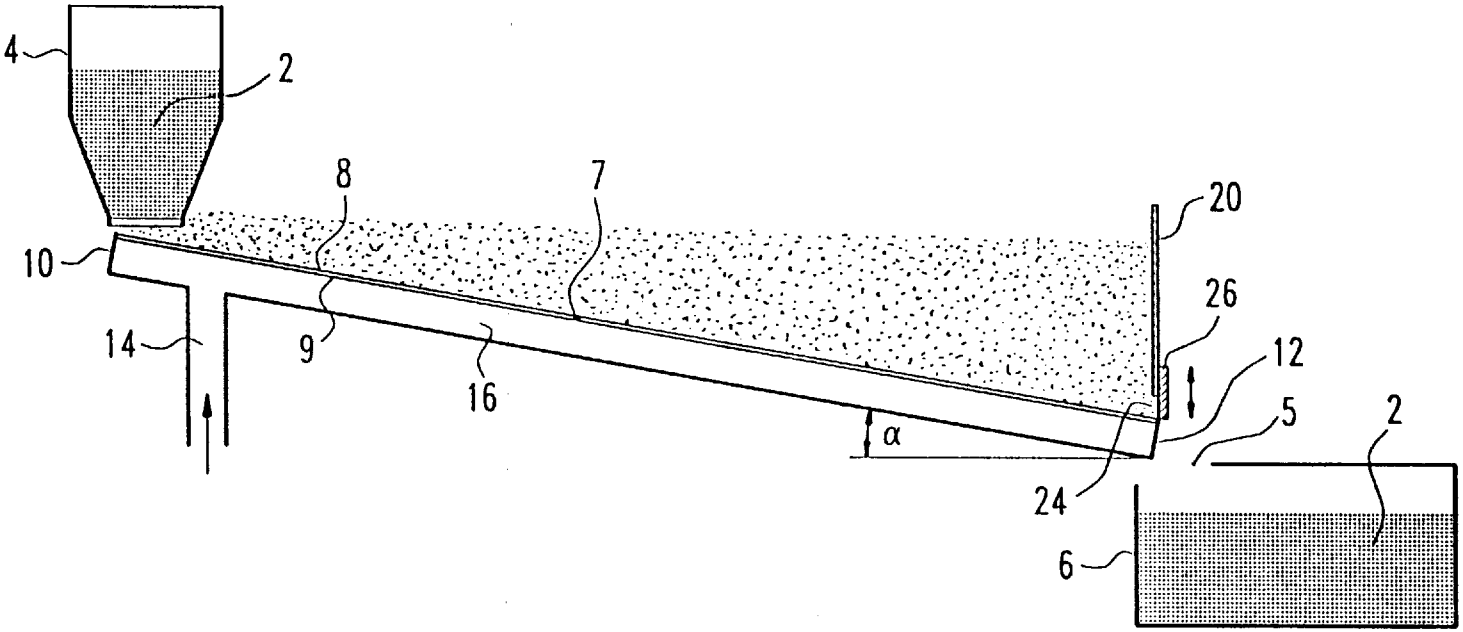
FIG. 4 shows a side cross sectional view of a fourth exemplary embodiment with a closeable flap.

FIG. 4 shows a fourth exemplary embodiment of the inventive apparatus. It differs from the embodiment of FIG. 3 on the basis of an opening 24 at the apex formed by the barrier 20 and the porous plate 7. The opening 24 can be opened or closed as needed with a closure element 26. The drive of this closure 26 preferably ensues electromagnetically or pneumatically. In this embodiment, as in the previous, a delay-free toner delivery into the developer station 6 can be realized given an at least partly filled toner store by opening the closure 26 element.

Figure 5:
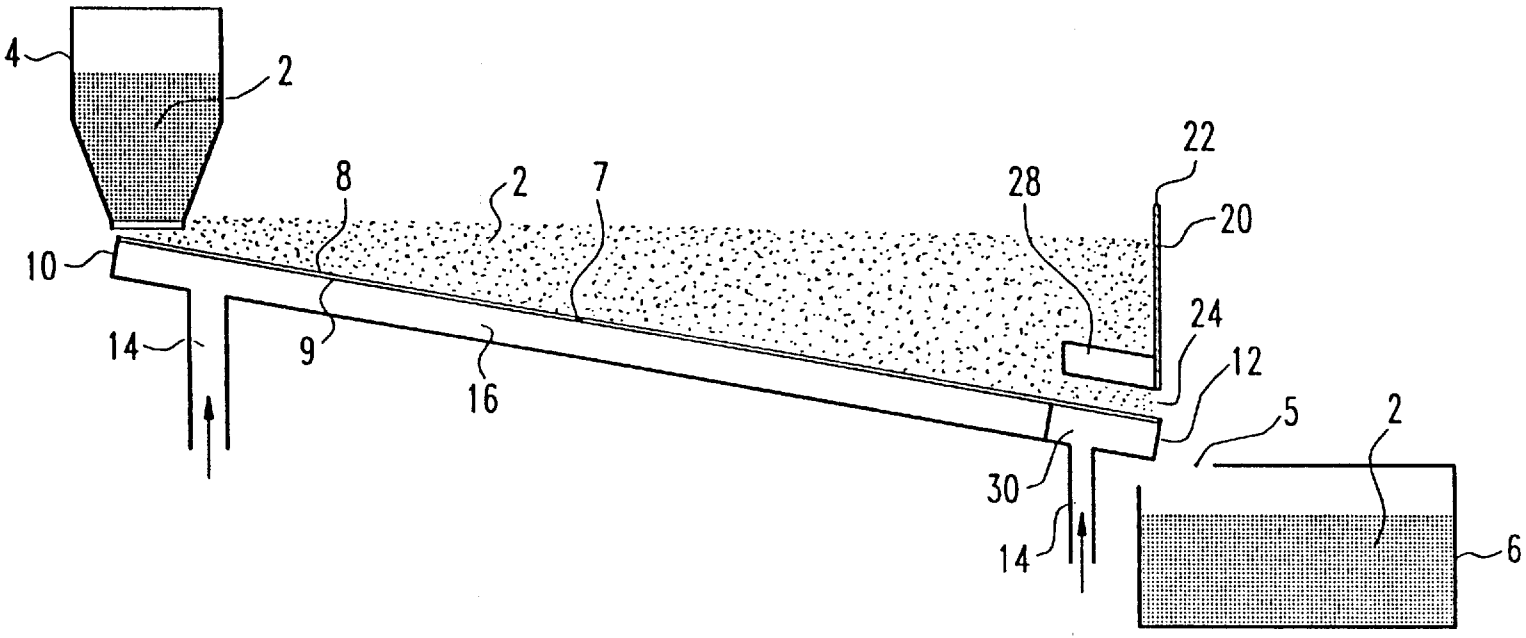
FIG. 5 shows a side cross sectional view of a fifth exemplary embodiment of the invention with an additional compressed air chamber.

FIG. 5 shows a fifth exemplary embodiment of the inventive apparatus. This embodiment enables a specific pneumatic drive for the opening and closing of the opening 24 at the apex formed of the barrier 20 and the porous bed 7. A separate sub-chamber 30 that can be selectively charged with compressed air 14 independently of the chamber 16 is located at the lower end 12 of the porous bed 7. A further sub-chamber 28 which is chargeable with compressed air 14 is located above this sub-chamber 30 and is disposed parallel thereto.

When the lower sub-chamber 30 is not charged with compressed air 14 and the chamber 16 as well as the upper sub-chamber 28 are simultaneously charged with compressed air, no fluidized toner is located in the region of the opening 24 between the two sub-chambers 28 and 30. The toner 2 can thus not escape through the opening 24. When, however, the lower sub-chamber 30 is likewise charged with compressed air, then a region with fluidized toner develops in the region of the opening 24 between the two sub-chambers 28 and 30, so that the opening 24 is opened and the toner 2 can flow into the developer station 6.

Thus, there is shown various embodiments of an apparatus having a porous bed charged with compressed air over which toner particles flow as a fluid. Control of the particle movement is effected by controlling air flow, segmenting the air flow, or providing one or more barriers or baffles along the flow path. Gentle handling of the particles is assured. Although toner particles are described, other particles may be transported in this way, as well.

Although other modifications and changes may be suggested by those skilled in the art, it is the intention of the inventors to embody within the patent warranted hereon all changes and modifications as reasonably and properly come within the scope of their contribution to the art.

We claim:

1. An apparatus for transporting finely powdered toner material in a printer or copier from a reservoir for the finely powdered material to a delivery opening, comprising:

a bed extending in the printer or copier from the reservoir to the delivery opening, said bed having an upper end located at the reservoir and being loaded with finely powdered toner material from the reservoir on an upper surface, said bed having a lower end located at the delivery opening at which the finely powdered toner material is delivered from the bed, said bed being porous at least in sections, said bed being mounted at a downward grade between the reservoir and the delivery opening, said downward grade having a maximum slant smaller than an angle of repose of the finely powdered material, and means for charging said bed with compressed air proceeding from an underside of said bed.

2. An apparatus according to claim 1, wherein said bed forms an oblique plane with a down grade having a constant slant, and said bed being porous over its entire length.

3. An apparatus according to claim 1, wherein the reservoir is located above the upper end of said bed and a destination location is located under the lower end of said bed.

4. An apparatus according to claim 1, wherein pores of said bed are of a diameter that is smaller than a diameter of particles of the finely powdered toner material.

5. An apparatus according to claim 1, wherein said means for charging the bed with compressed air includes a through chamber connected to a compressed air source, said through chamber being located at the underside of the bed extending from the upper end to the lower end.

6. An apparatus according to claim 5, wherein said chamber is divided into sub-chambers separated air-tight from one another along the downward grade, said sub-chambers being separately chargeable with compressed air so that finely powdered material that is located on the upper surface of the bed is separately fluidized in sub-regions along the downward grade.

7. An apparatus according to claim 6, further comprising:

means for separately charging each of said sub-chambers with compressed air from a compressed air source.

8. An apparatus according to claim 6, further comprising:

a plurality of substantially vertically residing barriers along a linear portion of said bed each having at least one opening at a lower edge in a region of said upper surface of said bed, said plurality of substantially vertically residing barriers being provided at respective ones of said sub-regions.

9. An apparatus as claimed in claim 6, wherein said chamber is divided into at least three of said sub-chambers disposed adjacent one another and aligned linearly along the downward grade.

10. An apparatus according to claim 1, further comprising:

at least one substantially vertically residing barrier at said upper surface of the bed.

11. An apparatus according to claim 10, wherein said at least one substantially vertically residing barrier is attached at the lower end of the bed.

12. An apparatus according to claim 10, wherein said at least one substantially vertically residing barrier includes a plurality of successive barriers attached along a linear portion of the downward grade.

13. An apparatus according to claim 10, wherein said at least one substantially vertically residing barrier includes an overflow at an upper edge.

14. An apparatus according to claim 10, wherein said at least one substantially vertically residing barrier has at least one opening at a lower edge in a region of said upper surface of the bed through which toner is conveyed onto further portions of the bed.

15. A method for transporting finely powdered toner material in a printer or copier device, comprising the following steps:

loading a porous bed positioned at a downward grade in the printer or copier device with finely powdered toner material from a reservoir in a region of an upper end of the porous bed;

charging the porous bed with compressed air proceeding from an underside of said porous bed so that the finely powdered toner material deposited on an upper surface of the porous bed is fluidized and begins to flow along the downward grade from the upper end of the porous bed to the lower end of the porous bed under the influence of the force of gravity;

delivering the fluidized finely powdered toner material arriving at the lower end of the porous bed at a delivery opening.

* * * * *